US009181066B2

(12) United States Patent
Fan et al.

(10) Patent No.: US 9,181,066 B2
(45) Date of Patent: Nov. 10, 2015

(54) PASSENGER CONVEYOR

(71) Applicants: Jinquan Fan, Kunshan (CN); Antti Plathin, Vantaa (FI); Yu Wei, Kunshan (CN); Visa Rauta, Hyvinkaa (FI); Yimin Shi, Changzhou (CN)

(72) Inventors: Jinquan Fan, Kunshan (CN); Antti Plathin, Vantaa (FI); Yu Wei, Kunshan (CN); Visa Rauta, Hyvinkaa (FI); Yimin Shi, Changzhou (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/205,731

(22) Filed: Mar. 12, 2014

(65) Prior Publication Data

US 2014/0190790 A1 Jul. 10, 2014

Related U.S. Application Data

(63) Continuation of application No. PCT/CN2011/079667, filed on Sep. 15, 2011.

(51) Int. Cl.

| | |
|---|---|
| ***B66B 25/00*** | (2006.01) |
| ***B66B 23/14*** | (2006.01) |
| ***B66B 29/08*** | (2006.01) |
| ***B66B 23/00*** | (2006.01) |
| ***B66B 27/00*** | (2006.01) |

(52) U.S. Cl.

CPC ..... *B66B 23/14* (2013.01); *B66B 23/00* (2013.01); *B66B 27/00* (2013.01); *B66B 29/08* (2013.01)

(58) Field of Classification Search

CPC ..... B66B 25/00; B66B 27/00; B66B 29/08
USPC ..... 198/322, 324
See application file for complete search history.

(56) References Cited

U.S. PATENT DOCUMENTS

| | | | | |
|---|---|---|---|---|
| 6,334,522 | B2 * | 1/2002 | Haruta et al. | 198/322 |
| 6,988,607 | B2 * | 1/2006 | Blondiau et al. | 198/322 |
| 7,404,476 | B2 * | 7/2008 | Yoshida | 198/324 |
| 7,537,101 | B2 * | 5/2009 | Aulanko et al. | 198/322 |
| 2001/0002644 | A1 * | 6/2001 | Haruta et al. | 198/322 |

(Continued)

FOREIGN PATENT DOCUMENTS

| | | | |
|---|---|---|---|
| CN | 1626430 | A | 6/2005 |
| CN | 201217598 | Y | 4/2009 |
| CN | 100569624 | C | 12/2009 |
| JP | H05-24780 | A | 2/1993 |

(Continued)

OTHER PUBLICATIONS

International Search Report for PCT/CN2011/079667 dated Jun. 21, 2012.
Written Opinion for PCT/CN2011/079667 dated Jun. 21, 2012.

*Primary Examiner* — James R Bidwell
(74) *Attorney, Agent, or Firm* — Harness, Dickey & Pierce, P.L.C.

(57) ABSTRACT

A passenger conveyor comprising an endless conveyor track, a power source configured to supply power to said endless conveyor track, an entrance allowing a passage to the conveyor track, an exit allowing a passage away from the conveyor track, and a balustrade beside the conveyor track. Guide elements are positioned at the entrance/exit on a floor at proximity of an end of the balustrade. The guide elements are laterally elongated, and are configured to guide rolling or moving objects to/from the conveyor without contacting or being obstructed by the balustrade. The guide elements include a source of electromagnetic waves which radiate the electromagnetic waves to an entrance/exit zone of the passenger conveyor.

22 Claims, 3 Drawing Sheets

(56) References Cited

U.S. PATENT DOCUMENTS

Figure 1:
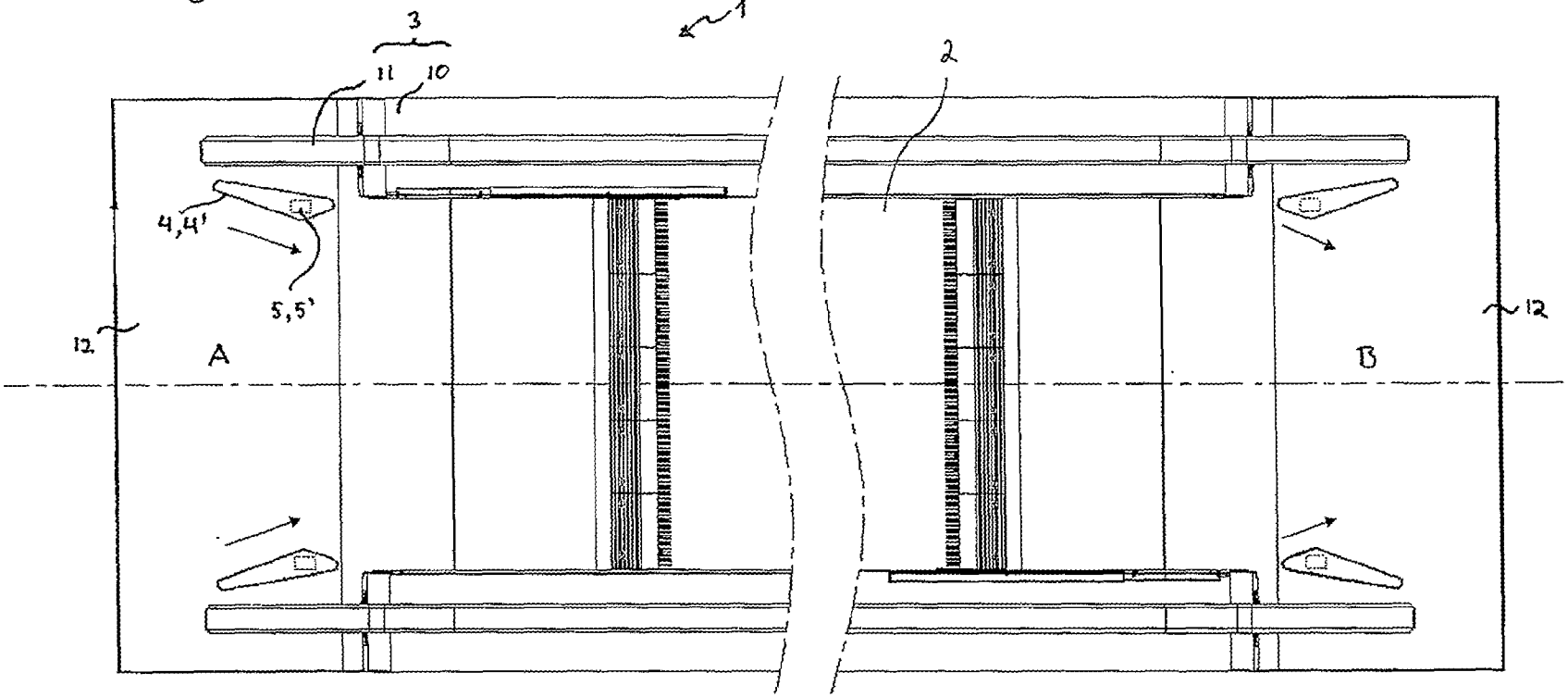

| | | | | |
|---|---|---|---|---|
| 2005/0121288 | A1* | 6/2005 | Blondiau et al. | 198/322 |
| 2009/0120727 | A1 | 5/2009 | Hamaji et al. | |
| 2012/0022700 | A1 | 1/2012 | Drees et al. | |

FOREIGN PATENT DOCUMENTS

| | | | |
|---|---|---|---|
| JP | 2004-051294 | A | 2/2004 |
| JP | 2006-131373 | A | 5/2006 |
| JP | 2008-013290 | A | 1/2008 |

* cited by examiner

PASSENGER CONVEYOR

This application is a continuation of PCT International Application No. PCT/CN2011/079667 which has an International filing date of Sep. 15, 2011, the entire contents of which are incorporated herein by reference.

FIELD OF THE INVENTION

The object of the invention is a passenger conveyor, especially an autowalk or an escalator.

BACKGROUND OF THE INVENTION

It is known to use an endless conveyor track for transporting passengers so that the passengers are transported on top of a moving conveyor track. For instance, autowalks and escalators are this type of passenger conveyors. Escalators have a plurality of steps connected to each other. The steps serve as conveying elements on top of which the passengers are to be transported from entrance level to exit level. In autowalks, a plurality of pallets, which are connected to each other, are often used as the conveying elements so that they together form a conveying surface on top of which the passengers are transported, which is essentially stepless throughout the track section which is accessible to passengers. An autowalk can be a horizontal or an inclined autowalk (moving ramp). Also such autowalks exist, where the conveyor track is in the form of an endless belt.

Passenger conveyors may include auxiliary devices/elements at its entrance and/or exit to provide additional functions for the passenger conveyor. Such devices/elements are e.g. those meant to guide the passengers. A special need for guidance may rise, for instance, when a passenger arriving to the passenger conveyor is transporting big objects, which he needs to bring on the conveyor with him. Such objects may include a bag, a shopping trolley or other objects the passenger wants bring onto the conveyor track. In some countries it may be even allowed to take a baby carriage to the conveyor. It is known to position a guide element or guide elements, at the entrance and/or at the exit of the passenger conveyor, which guide element defines lateral limit to movement of the rolling object. These guide elements are sometimes called as trolley guides. A guide element may be installed on the floor at proximity of the balustrade end, forming an elongated lateral guide for an object rolling on the floor to/from the conveyor, so as to guide the rolling object to/from the conveyor without contacting the balustrade. Another need for guidance is the need for indicating the passenger the running direction of the passenger conveyor sufficiently early so he avoids walking onto the conveyor at its exit. This could otherwise easily happen for instance when the conveyor is in standby mode. This problem has been solved by installing light signaling devices in the balustrade, which radiate light towards the entrance/exit zone. This light is of suitable color to indicate the passenger the running direction of the passenger conveyor. The auxiliary devices may include also traffic detectors. A need for detecting passenger presence has made it common in modern passenger conveyors that the sender and the receiver of a proximity sensor are installed in the balustrade, usually in the balustrade pedestal, which produce a detecting beam towards the entrance/exit zone, i.e. the space in front of the conveyor track via which space the passenger must pass so as to get on the conveyor track or away from it. If the detecting beam is cut by a passenger or an object he's transporting, the passenger conveyor system may take it into account and control the passenger conveyor based on the detection. Alternatively the detection can be used for passenger counting, or the detections in entrance and exit zone can be compared for determining whether the conveyor track is empty of passengers.

In prior art, a set of auxiliary devices/elements chosen by the client has been included in the passenger conveyor by adding several separate devices on the passenger conveyor. A problem has been that the passenger conveyor entrance/exits have eventually had multiple devices/elements for auxiliary functions, which have required separate installing positions and wirings. They are all protected separately from vandalism or impacts. On the other hand also adding the auxiliary components and functions as add-on features, has not been optimal. For instance in modernization it required dismantling, and rewiring and on-site work. The auxiliary devices have not been visually nor structurally compatible to each other, so multiple separate devices have been installed. The devices have been large or due to compromises their positioning has not been adequate to achieve optimal reliability of the function.

AIM OF THE INVENTION

The aim of the invention is to eliminate, among others, the aforementioned drawbacks of prior-art solutions. More particularly the aim of the invention is to produce a passenger conveyor, where several auxiliary functions can be included in the passenger conveyor system with a simple overall construction. Additionally, a new advantageous shape for a guide element is brought forward.

SUMMARY OF THE INVENTION

The invention is based on an idea that adaptability and simplicity of passenger conveyor function configuration can be improved by combining together into one element a plurality of functions, which functions share a beneficial positioning both laterally and vertically.

In a basic embodiment of the passenger conveyor according to the invention, the passenger conveyor comprises an endless conveyor track, which preferably has a conveying surface on which the conveyance is to be moved, which conveying track is preferably formed of consecutive conveying elements, such as pallets or steps, and a power means for moving said conveyor track, and an entrance in the form of a walkway, allowing passage to the conveyor track, and an exit in the form of a walkway, allowing passage away from the conveyor track, and a balustrade beside the conveyor track, and a guide element or guide elements, which is/are at the entrance and/or at the exit, on the floor at proximity of the end of the balustrade, forming an elongated lateral guide for an object, which object is rolling on the floor to/from the conveyor track, so as to guide the rolling object to/from the conveyor without contacting the balustrade. According to the invention, one or more of said guide elements is such that it comprises a source of electromagnetic radiation, adapted to output electromagnetic radiation to the entrance/exit zone of the passenger conveyor. Thus, one or more above described advantages can be achieved. Thus, for instance, the radiation reaches reliably the passenger or an object transported by him, from an optimal angle. The location is advantageous, as the radiation can easily be directed upwards so that it does not hit in large scale the floor, which would cause undesired reflections. The guide element is simple to form as an add-on feature, and it may be arranged to provide plural of escalator functions simultaneously with minimal effect on the conveyor structure.

In a preferred embodiment said guide element is at most 10 cm in height, preferably at most 5 cm in height, most preferably at most 35 mm in height. The element is thus inconspicuous. Also, it can extend below the handrail of the balustrade. It also affects only the lowest parts of the rolling object. One can also easily step over it and it does not considerably limit movement of objects other than objects which are rolling.

In a preferred embodiment said guide element is at least partially located in front of projection of the balustrade (when observed in running direction), especially in front of the projection of the balustrade structures which structures are immediately above the floor level, in practice normally is the pedestal of the balustrade. Thus, it effectively reduces collisions.

In a preferred embodiment said guide element forms a longitudinal side wall of the path leading to/from the conveyor track, which side wall extends above the level of the floor of the entrance/exit. Thus, it is suitable to guide an object rolling on the floor to/from the conveyor track, and to define a lateral limit to movement of the rolling object.

In a preferred embodiment said guide element has a guide surface facing away from the conveyor at an inclined angle with respect to running direction. Thus, the guide element forms an effective means for guiding the movement into correct direction instead of mere blocking movement to undesired direction.

In a preferred embodiment said source of electromagnetic radiation is a source of visible light configured to radiate visible light to the entrance/exit zone towards the passenger/objects. Said source of visible light may comprise a led component or plurality of led-components.

In a preferred embodiment said light source is comprised in a guide element located in proximity of the exit of the passenger conveyor and radiates visible red light towards the exit zone. This is sufficient to tell most passengers not to enter the conveyor.

In a preferred embodiment said light source is comprised in a guide element located in proximity of the entrance of the passenger conveyor and radiates green or blue light towards the entrance zone. This is sufficient to tell most passengers that entering the conveyor is allowed.

In a preferred embodiment the light source is arranged to generate non-constant visible lighting effect. Thus, attention is effectively drawn to the guide element and correct path can be informed to the passenger, and thus propability of collisions can be reduced.

In a preferred embodiment said source of electromagnetic radiation forms a part of a proximity sensor, arranged to detect objects, such as passengers or rolling objects moving in the entrance/exit zone.

In a preferred embodiment the passenger conveyor, especially a guide element comprises a receiver for receiving reflections of the electromagnetic waves sent by said source of electromagnetic radiation, from objects, such as passengers or rolling objects, moving in the entrance/exit zone. The receiver may be integral with or separate of the source of radiation. Some sort of means for evaluating the detection signal is preferably connected to the receiver.

In a preferred embodiment said source of electromagnetic radiation forms a part of a proximity sensor, arranged to detect objects, such as passengers or rolling objects moving in the entrance/exit zone, and the passenger conveyor is configured to set the speed of the conveyor track based on the detection, such as initiate start-up or wake-up of stand-by-mode if objects are detected within the entrance zone by the proximity sensor. Thus, the conveyor is intelligent and may be designed more economical or safe.

In a preferred embodiment the guide element is fixed on entrance plate of the passenger conveyor.

In a preferred embodiment the guide element comprises a body having an inside space accommodating components of the source of electromagnetic radiation.

In a preferred embodiment the body is made of polymer material, preferably elastomer, such as rubber. Thus, the element is easy to make suitable to absorb collision energy.

In a preferred embodiment the body is opaque to visible light. Thus, components of the source of radiation can be hidden.

In a preferred embodiment said source of electromagnetic radiation is adapted to radiate electromagnetic waves through a member of the guide element that is opaque to visible light, preferably through the body or a window formed in the body, which body or window is opaque to visible light, and the electromagnetic waves have a wave length between 1 mm-1 m, the waves preferably being microwaves, preferably in the range 24.05 GHz-24.25 GHz, most preferably 24.125 GHz. Thus components of the source of radiation can be hidden, yet the function is not disturbed.

In a basic embodiment of the guide element according to the invention, the guide element comprises a source of electromagnetic waves. It is a guide element for a passenger conveyor, to be installed at the entrance and/or exit of the passenger conveyor, on the floor at proximity of the balustrade end, which is an elongated lateral guide for an object rolling on the floor to/from the conveyor, so as to guide the rolling object to/from the conveyor without contacting the balustrade. Thus, inter alia one or more of the aforementioned advantages are achieved.

In a preferred embodiment the guide element comprises a hollow inside space for accommodating electrical components, and at least part of components of said source of electromagnetic waves are positioned in said hollow space.

In a preferred embodiment the guide element comprises a channel for electric wiring, which channel leads into said hollow inside space.

In a preferred embodiment the guide element comprises a bottom side adapted to be fixed on a fixed surface, the bottom side comprising said channel for electric wiring.

In a preferred embodiment the guide element is at most 10 cm in height, preferably at most 5 cm in height, most preferably at most 35 mm in height, and it comprises a guide surface which is elongated in lateral direction.

In a preferred embodiment said source of electromagnetic radiation is configured to radiate visible light.

In a preferred embodiment said source of electromagnetic radiation forms a part of a proximity sensor.

In a preferred embodiment said source of electromagnetic radiation is configured to radiate electromagnetic waves which have a wave length between 1 mm-1 m, the waves preferably being microwaves, preferably in the range 24.05 GHz-24.25 GHz, most preferably 24.125 GHz.

In a preferred embodiment the guide element comprises a body of polymer material, preferably elastomer material.

In a preferred embodiment said source of electromagnetic radiation is adapted to radiate electromagnetic waves through a member of the guide element that is opaque to visible light, preferably through the body or a window formed in the body, which body or window is opaque to visible light, and the electromagnetic waves have a wave length between 1 mm-1 m, the waves preferably being microwaves, preferably in the range 24.05 GHz-24.25 GHz, most preferably 24.125 GHz.

In a preferred embodiment the guide element has a first, second and third guide surfaces which form together a sequence of guiding surfaces, and the first and third guide surface face away from each other symmetrically relative to the second guide surface. A benefit is, that the guide element is likely to be installed correct position, because the guide surface sequence is similar in both running directions.

Some inventive embodiments are also presented in the descriptive section and in the drawings of the present application. The inventive content in the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features or procedures of each embodiment can also alone and separately from the other embodiments form a separate invention. For example, the shape and/or particular positioning of the guide element may form a separate invention independently whether additional functions are integrated in the guide element.

LIST OF FIGURES

In the following, the invention will be described in detail by the aid of some examples of its embodiments with reference to the attached drawings, wherein FIG. 1 presents the passenger conveyor according to the invention as viewed from above.

Figure 2:
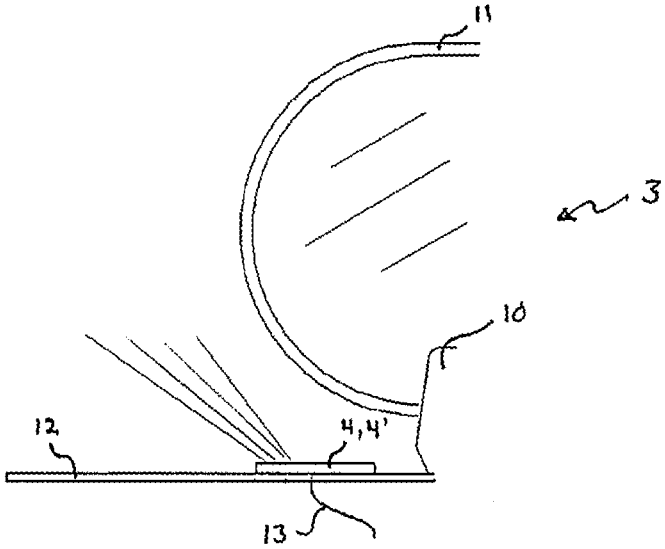

FIG. 2 presents a side view of an end of the passenger conveyor of FIG. 1.

Figure 3:
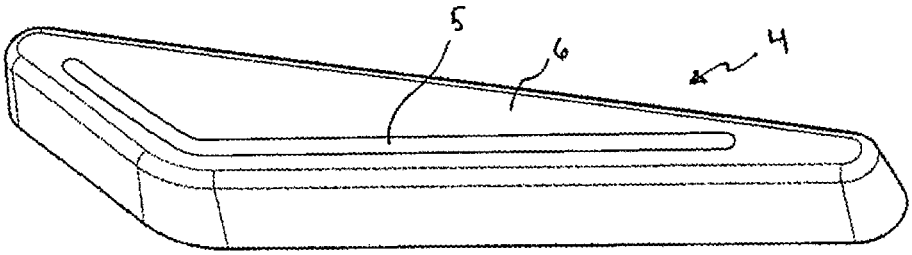

FIG. 3 presents a guide element according to first embodiment of the invention, which can be utilized in passenger conveyor of FIG. 1.

Figure 4:
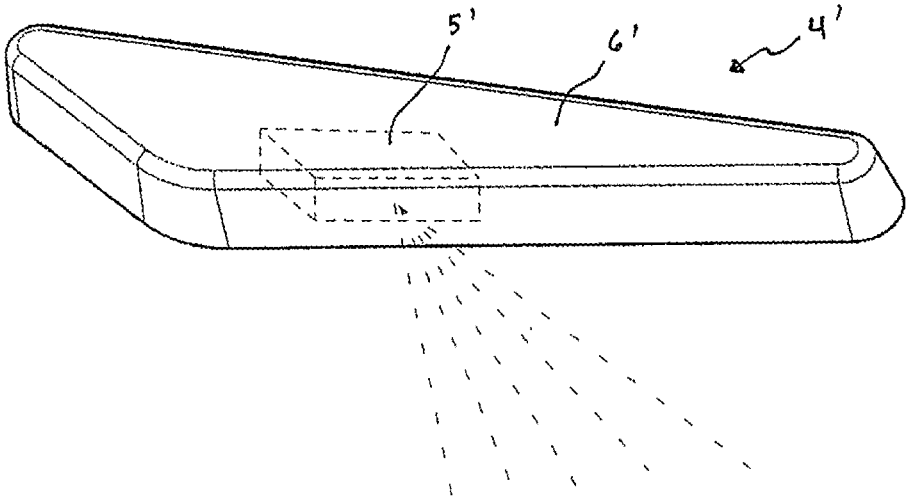

FIG. 4 presents a guide element according to second embodiment of the invention, which can be utilized in passenger conveyor of FIG. 1.

Figure 5:
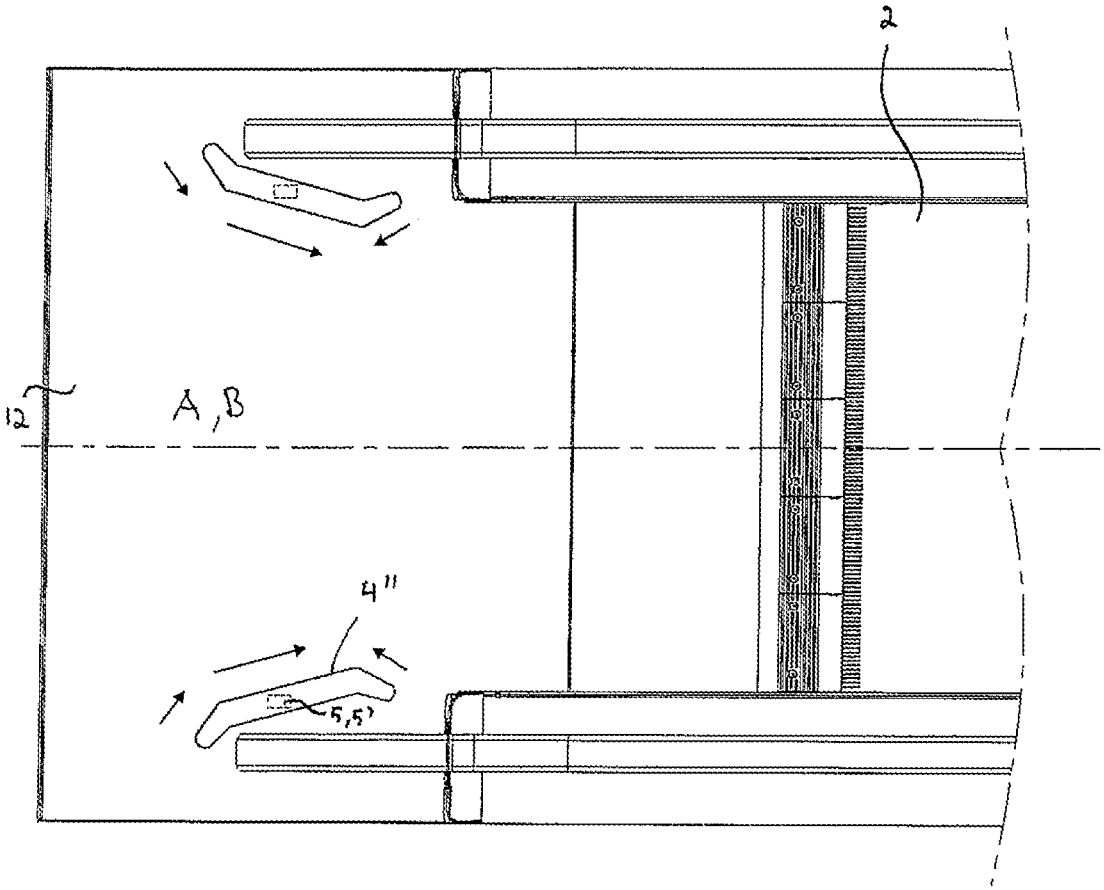

FIG. 5 presents one end of the passenger conveyor according to the invention as viewed from above, having a guide element according to the invention, and where the guide element has an alternative shape.

Figure 6:
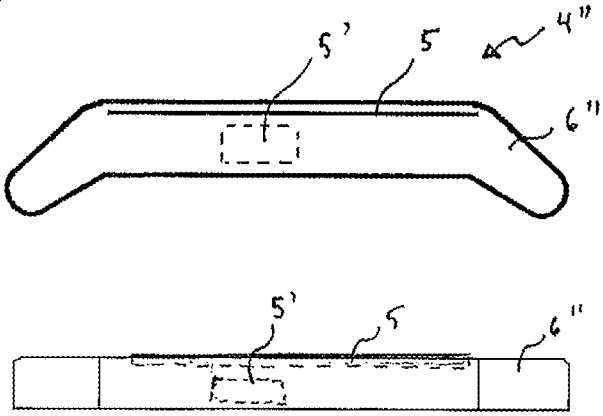

FIG. 6 presents a top view and a side view the guide element showed in FIG. 5.

DETAILED DESCRIPTION OF THE INVENTION

FIG. 1 presents the passenger conveyor 1 according to the invention as viewed from above. It comprises an endless conveyor track 2, having a conveying surface on which the conveyance is to be moved. The conveying track 2 is formed preferably of consecutive conveying elements, such as pallets or steps, but not necessarily, as a belt conveyor could be used alternatively. Further, it comprises a power means (not shown) for moving said conveyor track 2, and an entrance A in the form of a walkway, allowing passage to the conveyor track 2, an exit B in the form of a walkway, allowing passage away from the conveyor track 2. Further, it comprises a balustrade 3 beside the conveyor track, which runs parallelly along the conveyor track essentially the whole length of it. The balustrade, as shown in the figures, can comprise a moving handrail 11 and stationary structures 10, such as balustrade pedestal. The passenger conveyor 1 comprises guide elements 4,4', at the entrance A and at the exit B, on the floor at proximity of the end of the balustrade 3, each of which guide element 4,4' forms an elongated lateral guide for an object rolling on the floor to/from the conveyor track, so as to guide the rolling object to/from the conveyor track without contacting the balustrade 3. Guide elements 4,4' could be positioned alternatively in one end only. Although preferable, it is not absolutely necessary to have a guide element 4,4' on both lateral sides of the walkway leading to the conveyor track. One or more of the guide elements 4,4', possibly all the guide elements 4,4' as depicted (only schematically) in FIG. 1, comprises a source of electromagnetic radiation 5,5', adapted to output electromagnetic radiation (electromagnetic waves) to the entrance/exit zone of the passenger conveyor, i.e. to the space in front of the conveyor track 2 via which space the passenger must pass so as to get on the conveyor track 2 or away from it. The outputted radiation is preferably in the form of a beam, having a suitably large angle to have large coverage. The beam is preferably directed to shine so it can reach the relevant parts of the passengers/the objects carried by the passengers. In FIG. 2 this is presented as an upwardly directed beam. In case of visible light, the beam may be very large. Each guide element 4,4' is preferably fixed on the upper surface of the structure known as entrance plate of the passenger conveyor. Thus, possible wiring and fixing will be easy to arrange on the bottom side of the guide element. FIG. 2 presents a side view of the entrance/exit of the passenger conveyor of FIG. 1, demonstrating a preferred position of the guide element 4,4' as well as side view of a possible beam angle. The angle of the beam may be bigger or smaller depending on for what purpose the beam is radiated towards the passenger. Said source of electromagnetic radiation comprised in the guide element can be a source of visible light configured to radiate visible light to the entrance/exit zone, so that visible light reaches the passenger and can be seen by the passenger. In this case, the light is used as a means for informing the passenger, preferably of running direction of the conveyor track 2 of the passenger conveyor in question. For this type of use, FIG. 3 presents a preferable configuration of the guide element 4. Alternatively, said source of electromagnetic radiation comprised in the guide element can form a part of a proximity sensor, arranged to detect objects, such as passengers or rolling objects moving in the entrance/exit zone. In this case, the passenger conveyor 1, especially the proximity sensor, comprises additionally means for receiving a reflection of the radiation radiated by said source of radiation. For this type of use, FIG. 4 presents a preferable configuration of the guide element. The receiver is most preferably comprised in same guide element as the radiation source, but it could also be located elsewhere, such as in another guide element, or in any other place at suitable proximity of the zone under detection. The proximity sensor can be in the form of a Doppler radar sensor. Also, the radiation transmitting and receiving operations can be in a single radiation source component, e.g. antenna. The signal can be reflected by the object/person and picked up by the receiver. Movement in the detection zone modifies the reflected signal. The conveyor can have means for analyzing the modification of the radiation, e.g. by comparing modified signal to the original signal. Although depicted so that one guide element 4,4' has only one type of aforementioned sources of electromagnetic radiation, it may be preferable to include both of these in one guide element, or at least construct the guide element to have ability to accommodate both types of sources of electromagnetic radiation simultanously. In practice, the guide element would then preferably have a place for accommodating a source of indicating light (visible light) and a place for accommodating a source of proximity sensor radiation. These, types may differ in the need of beam angle and direction. Therefore, it is preferable to form the guide element to have an optimal place for each of them.

The guide element 4,4' is a relatively low element, especially at most 10 cm in height, preferably at most 5 cm in height, most preferably at most 35 mm in height. Thus, it can function well in guiding the objects, by giving guidance by affecting the lower part of the object, especially being thus suitable to affect directly the roller or the structures at its immediate proximity. Thus, no contact is necessary in upper portions of the object. Thus, there are no risks of crushing fingers, or e.g. collision between the guide and an object being transported in a shopping cart. The structure is also simple and out of way of walking persons who don't have objects to be transported.

The guide element 4,4' is positioned so that it is on the floor at proximity of the balustrade end forming a blocking structure between the balustrade 3 and a rolling object approaching the balustrade, thus limiting the rolling object from moving more close towards balustrade 3. Preferably, it is at least partially located in front of projection of the balustrade 3 (when observed in running direction), especially in front of the projection of the balustrade structures which structures are immediately above the floor level, which in the figures is the pedestal 10 of the balustrade. The guide element 4,4' forms a longitudinal side wall of the path leading to/from the conveyor track, which side wall extends above the level of the floor of the entrance/exit, thus guiding the object rolling on the floor to/from the conveyor track, and defining lateral limit to its movement. Thus, it does not merely block the rolling movement towards balustrade, but is capable guiding the object by diverting its running direction past the balustrade 3 towards the conveyor track or away from the conveyor. For guiding the objects towards the conveyor track the guide comprises a guide surface facing away from the passenger conveyor at inclined angle. For guiding the objects away from the conveyor track the guide comprises a guide surface facing towards the conveyor track at inclined angle. To achieve most of the benefits the invention, simultaneous presence of these guide inclined guide surfaces is not necessary. It is also not necessary that the guide surface is at inclined angle, as the guide surface could be alternatively parallel to the running direction of the conveyor track 2.

The guide element 4 as presented in FIG. 3 comprises a source of visible light 5. When used in configuration as presented in FIGS. 1 and 2, the source 5 of visible light is configured to radiate visible light to the entrance/exit zone towards the passenger. In that case, the light can indicate the running direction, preferably by its color. Preferably, the light source 5, which is comprised in a guide element located in proximity of the exit of the passenger conveyor radiates red light towards the exit zone and the light source 5, which is comprised in a guide element located in proximity of the entrance of the passenger conveyor radiates green or blue light towards the entrance zone. Alternatively or additionally, the purpose of the light may be to inform the passenger of the edges of the path leading to/from the conveyor track. Thus, the passengers attention may be drawn to the guide element and he can move his object accordingly. In case the passenger does not notice the guide block despite the attention light, then the guide block ensures mechanically that the rolling object stays within the desired route. Thus, occurrence of collisions can be reduced. Thus, the guide block itself is protected and due to reduced amount of collisions, the passenger traffic can be kept fluent. When used only for attention purpose, the light color is preferably some color other that red or green, preferably white, yellow or blue. Said source 5 of visible light can comprise any known component/components for forming visible light, preferably either a led-component (e.g. OLED) or plurality of led-components. As the source of energy, the guide element preferably comprises an input for electricity, such as wiring for feeding electricity. Alternatively, the guide element may comprise a solar cell for producing electricity for the light source 5. If the guide element/its light needs to be even more eye-catching, the light source may be arranged to generate non-constant visible lighting effect, such as blinking, color changing, or the light source can be in the form of a light strip which has lightness alternating up and down in a wave-like manner progressing in the longitudinal direction of the strip.

The guide element 4' as presented in FIG. 4 comprises a source of electromagnetic radiation 5', which forms a part of a proximity sensor. When used in configuration as presented in FIGS. 1 and 2, the source 5' of electromagnetic radiation forms a part of a proximity sensor, which is arranged to detect objects, such as passengers or rolling objects moving in the entrance/exit zone. The passenger conveyor is configured to affect the control of the conveyor track based on detection, especially to set the speed of the conveyor based on the detection, such as initiate start-up or wake-up of stand-by-mode if objects are detected within the entrance zone by the proximity sensor. As the source of energy, the guide element preferably comprises an input of electricity. As a part of the proximity sensor, the passenger conveyor, preferably the guide element 4' comprises also a receiver for receiving reflections of the electromagnetic waves sent by said source of electromagnetic radiation, from objects, such as passengers or rolling objects, moving in the entrance/exit zone. The source 5' of electromagnetic radiation is preferably adapted to output electromagnetic waves, which have a wave length between 1 mm-1 m, preferably the waves being microwaves, preferably in the range 24.05 GHz-24.25 GHz, most preferably 24.125 GHz. Thus, a disturbance free detection is most easily obtained. Alternatively, the radiation can be infrared radiation.

In both preferred alternatives the guide element comprises a body 6,6' having an inside space accommodating components of the source 5,5' of electromagnetic radiation. The 6,6' body is preferably made of polymer material, preferably elastomer, such as rubber. The body is preferably black.

When used for mounting radiation source 5' (and possibly a receiver) of proximity sensor, the body may be opaque to visible light, thus making it the source 5' of radiation (and possibly the receiver) invisible from outside the body, when it is installed against a fixed structure 12. The source 5' of electromagnetic radiation is preferably adapted to radiate electromagnetic waves through a member of the guide element that is opaque to visible light, preferably through the opaque body 6' or a window formed in the body which window is opaque to visible light, and the electromagnetic waves have a wave length between 1 mm-1 m, preferably the waves are microwaves, preferably in the range 24.05 GHz-24.25 GHz, most preferably 24.125 GHz. Thus, the radiation is invisible to human eye and yet it can pass through most nonmetallic materials, such as polymer material. The body or the possible window formed in it, through which the radiation is radiated (and/or possibly reflected back) is formed to be transparent to the electromagnetic waves radiated by said source 5' of electromagnetic radiation, by selecting a suitable material, such as polymer material.

FIG. 5 presents a further embodiment of the invention where the body of the guide element is of different shape. All other features may be as in embodiment of FIG. 1. In the figure, only one end of conveyor is drawn, but the other end can have a corresponding structure. FIG. 6 presents more specifically the guide element of FIG. 5, from above and from side. Also in this embodiment the guide element 4" comprises a source of electromagnetic radiation. Especially, it may comprise a source of visible light 5 and/or a source 5' of electromagnetic radiation which forms a part of proximity sensor. These options are less schematically drawn to FIG. 6. The invisible portions of light source (located inside a hollow space of guide element 4") are drawn in broken line. In FIGS. 5 and 6. The form of the source of radiation 5,5' may be in any desired shape. In case a visible light source 5 is provided, it is made to be visible from outside the body 6" of the guide element. The guide element is at least partially located in front of horizontal projection of the balustrade 3 (when observed in running direction), especially in front of the projection of the balustrade structures which structures are immediately above the floor level, in practice normally is the pedestal of the balustrade. In this embodiment the guide element 4" is also at least partially in front of vertical projection of the movable handrail 11 (when observed in running direction). Thus, when entering the conveyor, the parts of the guide element 4" (on the FIG. 5 the leftmost portions of the guide element 4"), which are in front of vertical projection of the movable handrail 11, will block the rolling object from moving further towards the moving handrail. As this portion is formed to have a guide surface which forms a lateral side wall of the path leading to/from the conveyor track and faces in inclined angle away from the conveyor track, the object hitting the guide element 4" is guided towards the conveyor track and in cross direction away from the movable handrail 11. The outer shape of the guide element 4" is symmetrical so that similar component can be placed on both lateral sides of the path to/from the conveyor track 2. This also has the advantage that similar mold can be used in manufacturing. A considerable benefit is, that the guide element is likely to be installed correct position, because the guide surface sequence is similar in both running directions. The guide element 4" has (forming together a sequence of guiding surfaces) a first, second and third guide surfaces. The first and third guide surfaces are positioned symmetrically before and after the second guide surface. The first guide surface faces to a direction which is in acute angle relative to the facing direction of the second guide surface and the third guide surface faces to a direction which is in acute angle relative to the facing direction of the second guide surface. Thus, the first and third guide surface face away from each other symmetrically relative to the second guide surface.

It is obvious to the person skilled in the art that the invention is not limited to the embodiments described above, in which the invention is described using examples, but that many adaptations and different embodiments of the invention are possible within the frameworks of the inventive concept defined by the claims presented below.

What is claimed is:

1. A passenger conveyor, comprising:

an endless conveyor track;

a power source configured to supply power to said endless conveyor track for moving said endless conveyor track;

an entrance allowing a passage to the endless conveyor track;

an exit allowing a passage away from the endless conveyor track;

a balustrade on the side of the endless conveyor track;

at least a guide element at least at one of the entrance, the exit, and the entrance and exit, on a floor at proximity of an end of the balustrade, forming an elongated lateral guide for rolling or moving objects on the floor to/from the endless conveyor track to guide the rolling or moving object to/from the endless conveyor track without contacting the balustrade;

wherein said guide elements comprises at least a source of electromagnetic waves, configured to output the electromagnetic waves to at least one of an entrance zone and an exit zone of the passenger conveyor.

2. The passenger conveyor according to claim 1, wherein said guide elements are at most 10 cm in height.

3. The passenger conveyor according to claim 1, wherein said source of electromagnetic waves is a source of visible light configured to radiate the visible light to at least one of the entrance zone, the exit zone, and both the entrance and exit zones towards a passenger or an object.

4. The passenger conveyor according to claim 3, wherein said source of visible light is comprised in the guide elements and radiates visible red light to the exit zone.

5. The passenger conveyor according to claim 3, wherein said source of visible light is comprised in the guide elements and radiates visible green or blue light to the entrance zone.

6. The passenger conveyor according to claim 1, wherein said source of electromagnetic waves is a part of a proximity sensor configured to detect objects including passengers, or the rolling or moving objects in at least one of the entrance zone, the exit zone, and both the entrance and exit zones.

7. The passenger conveyor according to claim 1, wherein said source of electromagnetic waves is a part of a proximity sensor configured to detect objects including passengers, or the rolling or moving objects in at least one of the entrance zone, the exit zone, and both the entrance and exit zones, and wherein the passenger conveyor is configured to set a speed of the endless conveyor track based on the detection of the objects, or initiate start-up or wake-up from a stand-by-mode if the objects are detected within at least one of the entrance zone, the exit zone, and both the entrance and exit zones by the proximity sensor.

8. The passenger conveyor according to claim 1, wherein the guide elements are fixed on at least one of an entrance plate, an exit plate, and both the entrance and exit plates of the passenger conveyor.

9. The passenger conveyor according to claim 1, wherein the guide elements comprises a body having an inside space accommodating components of the source of electromagnetic waves.

10. The passenger conveyor according to claim 9, wherein the body is made of a polymer material including at least an elastomer or a rubber.

11. The passenger conveyor according to claim 1, wherein said source of electromagnetic waves is configured to radiate the electromagnetic waves through a member of the guide elements that is opaque to visible light, the member of the guide elements including at least an opaque window; wherein the electromagnetic waves includes at least one of electromagnetic waves of wave-length between 1 mm-1 m, microwaves, electromagnetic waves having a range of frequency between 24.05 GHz-24.25 GHz, and an electromagnetic wave of frequency of about 24.125 GHz.

12. A guide element for a passenger conveyor, configured to be arranged at least at one of an entrance, an exit, and both the entrance and exit of the passenger conveyor, on a floor at proximity of an end of a balustrade, the guide element comprising:

an elongated lateral guide configured to guide rolling or moving objects to/from the passenger conveyor without contacting the balustrade, and wherein the guide element includes at least one source of electromagnetic waves.

13. The guide element according to claim 12, further comprising:

a hollow space inside the guide element for accommodating electrical components of the source of electromagnetic waves, at least a part of the electrical components being positioned in said hollow space.

14. The guide element according to claim 13, further comprising:

a channel for electric wiring, which channel leads into said hollow space.

15. The guide element according to claim 14, further comprising:

a bottom side configured to be fixed on a fixed surface including at least a floor, the bottom side including said channel for the electric wiring.

16. The guide element according to claim 12, wherein said guide element is at most 10 cm in height, and includes at least a guide surface elongated in a lateral direction.

17. The guide element according to claim 12, wherein said source of electromagnetic waves is configured to radiate light including at least one of red light, green light, and blue light.

18. The guide element according to claim 12, wherein said source of electromagnetic waves is a part of a proximity sensor.

19. The guide element according to claim 12, wherein said source of electromagnetic waves is configured to radiate electromagnetic waves including at least one of electromagnetic waves of wave-length between 1 mm-1 m, microwaves, electromagnetic waves having a frequency in a range of 24.05 GHz-24.25 GHz, and an electromagnetic wave of frequency of about 24.125 GHz.

20. The guide element according to claim 12, further comprising:

a body of a polymer material, including at least an elastomer material.

21. The guide element according to claim 12, wherein said source of electromagnetic waves is configured to radiate electromagnetic waves through a member of the guide element that is opaque to visible light, the member of the guide element including at least an opaque window and wherein the electromagnetic waves include at least one of electromagnetic waves of wavelength between 1 mm-1 m, microwaves, electromagnetic waves having a range of frequency between 24.05 GHz-24.25 GHz, and an electromagnetic wave of frequency of about 24.125 GHz.

22. The guide element according to claim 12, further comprising:

a first, second and third guide surfaces which are configured to form a sequence of guiding surfaces, and wherein the first and third guide surfaces symmetrically face away from each other relative to the second guide surface.

* * * * *